United States Patent [19]

Taylor et al.

[11] Patent Number: 4,633,770

[45] Date of Patent: Jan. 6, 1987

[54] VARIABLE DISCHARGE GRILL FOR ROOM AIR CONDITIONER

[75] Inventors: Larry D. Taylor; David A. Reel; Gene R. Renfro, all of Louisville, Ky.

[73] Assignee: General Electric Company, Louisville, Ky.

[21] Appl. No.: 806,397

[22] Filed: Dec. 9, 1985

[51] Int. Cl.[4] ..... F24F 13/08; E06B 7/08

[52] U.S. Cl. ..... 98/94.2; 98/121.2; 49/64

[58] Field of Search ..... 98/40.17, 94.2, 103, 98/121.1; 49/64

[56] References Cited

U.S. PATENT DOCUMENTS

| | | | |
|---|---|---|---|
| 2,057,494 | 10/1936 | Leigh | 98/108 |
| 2,987,981 | 6/1961 | Boylan | 49/64 X |
| 3,306,182 | 2/1967 | Schwartz | 98/94 |
| 3,783,637 | 1/1974 | Woods | 62/427 |
| 3,921,507 | 11/1975 | Condet et al. | 98/114 X |
| 4,170,880 | 10/1979 | Lou | 62/262 |
| 4,203,566 | 5/1980 | Lord | 98/121.2 X |
| 4,304,175 | 12/1981 | Lang et al. | 98/94 |

*Primary Examiner*—William E. Wayner

*Attorney, Agent, or Firm*—Frank P. Giacalone; Radford M. Reams

[57] ABSTRACT

A variable discharge grille assembly is arranged in an air discharge opening of a room air conditioner. The assembly includes a frame surrounding the air discharge opening and a louvered air deflecting grille arranged in the frame. The louvered air deflecting grille is pivotally supported on the air discharge opening frame, and a built-in stop feature keeps the grille from coming out of the frame during operation. The position variations of the air deflecting grille relative to the air discharge opening frame is accomplished by a rachet arrangement that includes a yieldable finger on the grille which snaps into detents formed on the frame surrounding the air discharge opening.

5 Claims, 7 Drawing Figures

VARIABLE DISCHARGE GRILL FOR ROOM AIR CONDITIONER

BACKGROUND OF THE INVENTION

This invention relates to air-conditioning apparatus and, more particularly, to improved means for variably directing conditioned-air from air conditioning units which are mountable within an opening or window in a room. Because the location of the air conditioning unit is frequently dependent upon the location of available window space in the room, it is often impossible to position the unit in a location which will produce optimum distribution of the conditioned-air that is discharged from it. Obviously it is not always possible to locate the discharge outlet so that air flowing therefrom will produce the most effective distribution of air in the room.

To this end room air conditioners are generally provided with grille assemblies which may be positioned for directing air in selected directions. In many instances the air directional means include a plurality of vanes each of which is pivotally arranged so as to be positioned at a selected angle relative to the air flow. When this type of air deflection arrangement is employed each vane is interconnected through linkages so that they in fact move in unison. This requires that the several parts must be dimensioned and subsequently assembled in a manner that will allow movement and positioning of the several parts to readily accomplish the expected air deflection desired by the user. The arrangement requiring assembly of several parts even when accomplished to meet design requirements results in added costs due in part to the number of parts involved and, also in terms of the additional labor involved.

SUMMARY OF THE INVENTION

An object of the invention is to provide a reliable variable discharge grille assembly which is economical to manufacture and easy to assemble in a room air conditioning unit.

The variable discharge air grille assembly for an air conditioning unit includes a flow path in the air conditioner through which conditioned air is discharged to a space. An outer casing is provided which includes a discharge opening through which the conditioned air may flow. The discharge opening includes a frame in which a louvered grille for directing air passing through the opening is pivotally mounted. A built-in stop arrangement between the frame members limits movement of the louvered grille relative to the discharge opening. The position variations of the louvered grille is accomplished by a ratchet mechanism including a yieldable finger which snaps into spaced detents.

DESCRIPTION OF THE PREFERRED EMBODIMENT

Figure 1:
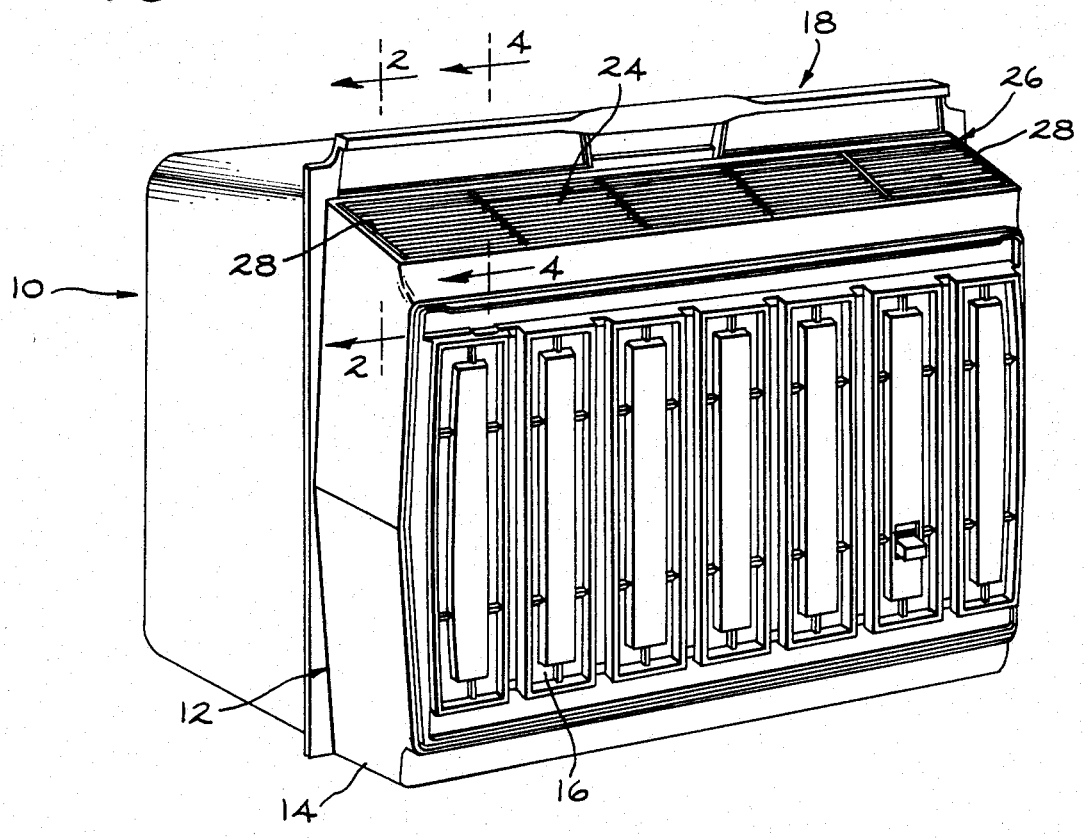
FIG. 1 is a perspective view of the casing of a room air conditioning unit and the discharge grille assembly embodying the present invention.

With reference to FIG. 1 of the drawings, there is illustrated a room air conditioning unit 10 comprising a casing 12 designed to contain the usual components (not shown) of an air conditioning system. The front or room side of the casing 12 is provided with a front panel or frame 14 including an air intake or inlet area generally indicated by the numeral 16 and an air discharge area 18 in which the present invention is incorporated.

Figure 2:
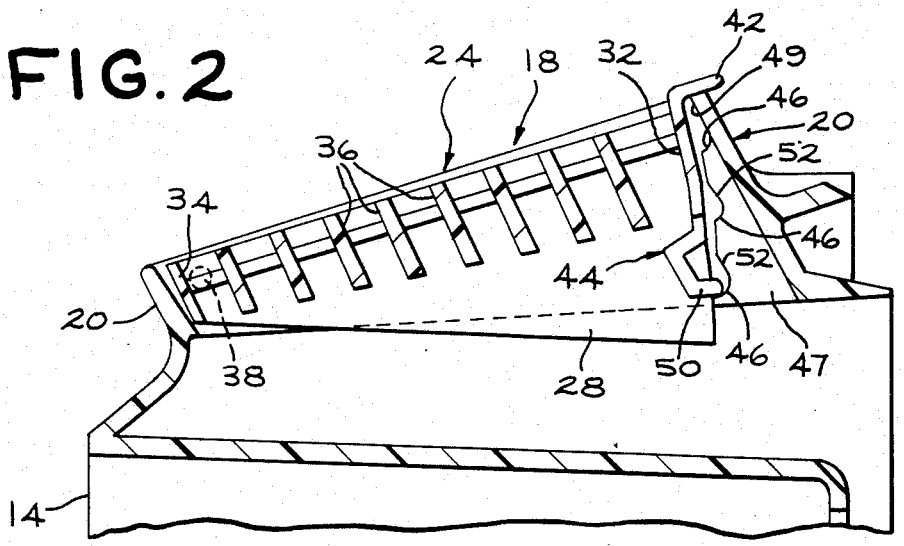
FIG. 2 is a sectional view taken along line 2—2 of FIG. 1 showing the discharge gille in its retracted position.
Figure 3:
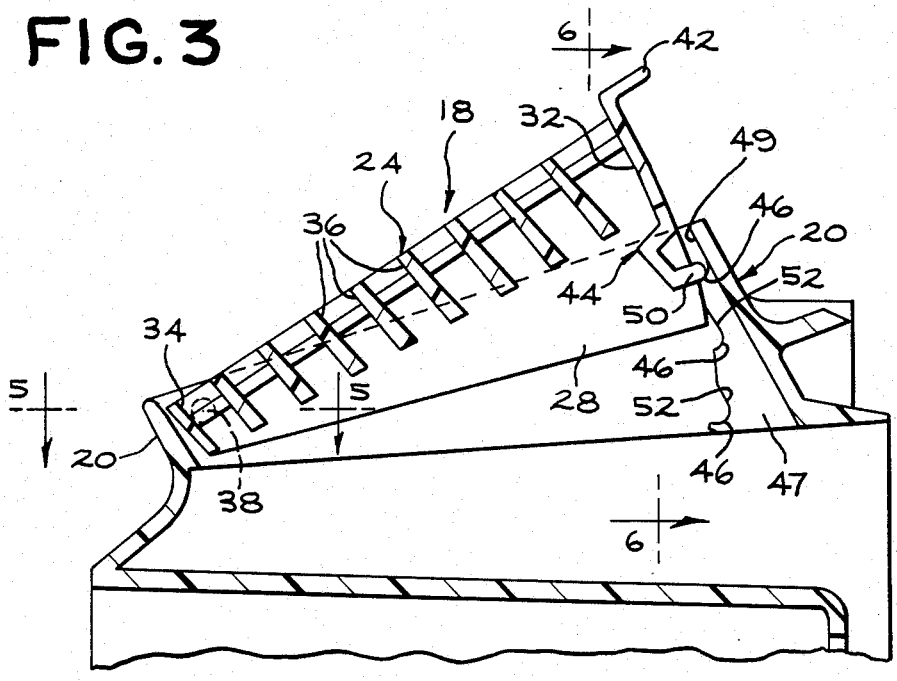
FIG. 3 is a sectional view similar to FIG. 2 showing the discharge grille in a selected air deflecting position.

Referring now to FIGS. 2 and 3, the construction of the air discharge area 18 of front panel 14 is illustrated. The air discharge area 18 comprises a generally rectangular frame section 20 formed integrally with front panel 14. Frame 20 defines a generally rectangular opening through which conditioned air is discharged. As will now be explained in accordance with the present invention an air deflecting louvered grille 24 is pivotally arranged in the frame opening 20. The air louvered grille 24 includes a generally rectangular frame 26 which is dimensional to be received in the frame opening 20. The frame 26 is fashioned with a pair of end walls 28 interconnected by an arcuate rear wall 32 and a generally vertical front wall 34. Arranged in generally spaced parallel relationship between the rear wall 32 and front wall 34 are a pluralilty of fixed louvers 36.

Figure 5:
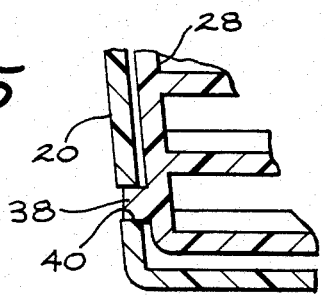
FIG. 5 is a fragmentary sectional view with parts broken away taken along line 5—5 of FIG. 3.

Referring to the drawings and more particularly in FIG. 2 wherein the grille 24 is shown in its normal or fully retracted position the louvers 36 are arranged to direct the conditioned air generally upwardly and slightly outwardly. By the present invention means are provided to direct air between this direction and a more outwardly direction as shown in FIG. 3. To this end, the front portions of the end walls 28 of the frame 26 are formed with pintles (FIG. 5) 38 which are pivotally supported in opening 40 in end walls of frame 20. Pintles 38 are located generally at the apex or point of generation of curvature of the arcuate rear wall 32.

Figure 4:
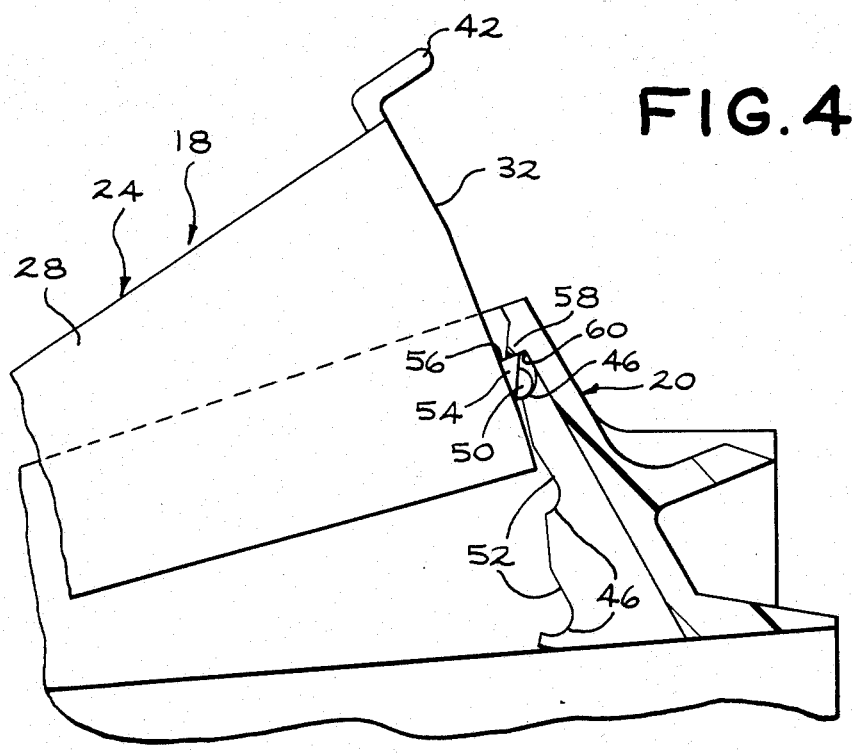
FIG. 4 is a sectional view taken along line 4—4 of FIG. 1 showing the grille in the position illustrated in FIG. 3 with the locking means engaged.

Accordingly the air deflecting grille 24 is adapted to be rotated about pintles 38 between the retracted position shown in FIG. 2 to the outwardly rotated or extended position shown in FIG. 4. Also provided by the present invention are means which effectively retain the air deflecting grille 24 in a selected position to which it is manually adjusted by means of a handle 42.

Figure 6:
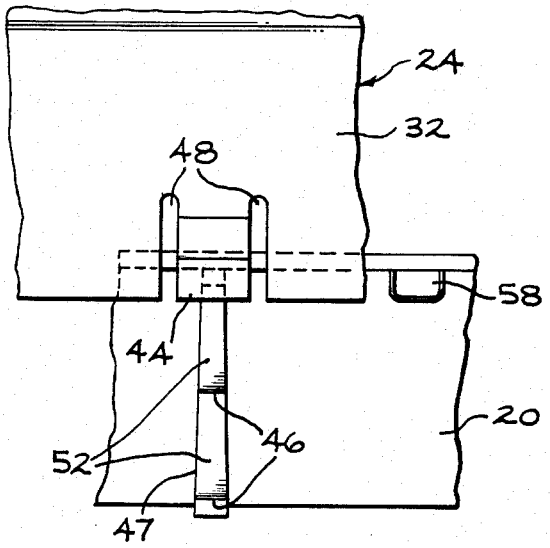
FIG. 6 is a fragmentary sectional view wth parts broken away taken along line 6—6 of FIG. 3.

This selective positioning of the deflection grille 24 is accomplished by a ratchet mechanism comprising yieldable tab 44 located in the rear wall 32 and cooperating detents 46. The detents 46 are formed on the forward edge of a rib member 47 which extends forwardly from the rear wall of frame 20. While any number of tabs and cooperating detents carrying rib members may be provided the present invention as shown was carried out employing a spaced pair of cooperating tabs and detent rib members with the drawing showing only one cooperating tab and detent rib member located toward the left-hand side of the air conditioning unit as viewed in FIG. 1. The tab 44 is formed as part of the rear wall 32 by providing two spaced parallel slits 48 as shown in FIG. 6. The tab 44 is viewed in FIGS. 2 and 3 and includes a rearwardly projecting finger portion 50. The front edge portion of member 47 is generally arcuate and is formed to include vertically spaced detents 46 which receive the finger portion 50 of tabs 44. The finger 50 at rest is located in the lower portion of the detents 46. The upper end of the detents 46 as shown in FIGS. 2–4 are formed to include a cam surface or incline 52 on which the finger portion rides as it moves to the next higher positioned detent. This arrangement facilitates the raising of the grille 24 while, at the same time offering some resistance to inadvertent downward movement.

Means are also provided by the present invention to prevent the grille 24 from being rotated out of the frame opening 20. To this end the wall 32 has formed thereon a rearwardly extending projection 54 which includes an upwardly facing flat surface 56. The rear wall of frame 20 is formed to include a forwardly extending projection 58 which includes a downwardly facing flat surface 60. As shown in FIG. 4 at the time the finger 50 engages the uppermost detent 46 the surface 56 of projection 54 engages the surface 60 of projection 58 thereby preventing further rotation of the grille 24.

Figure 7:
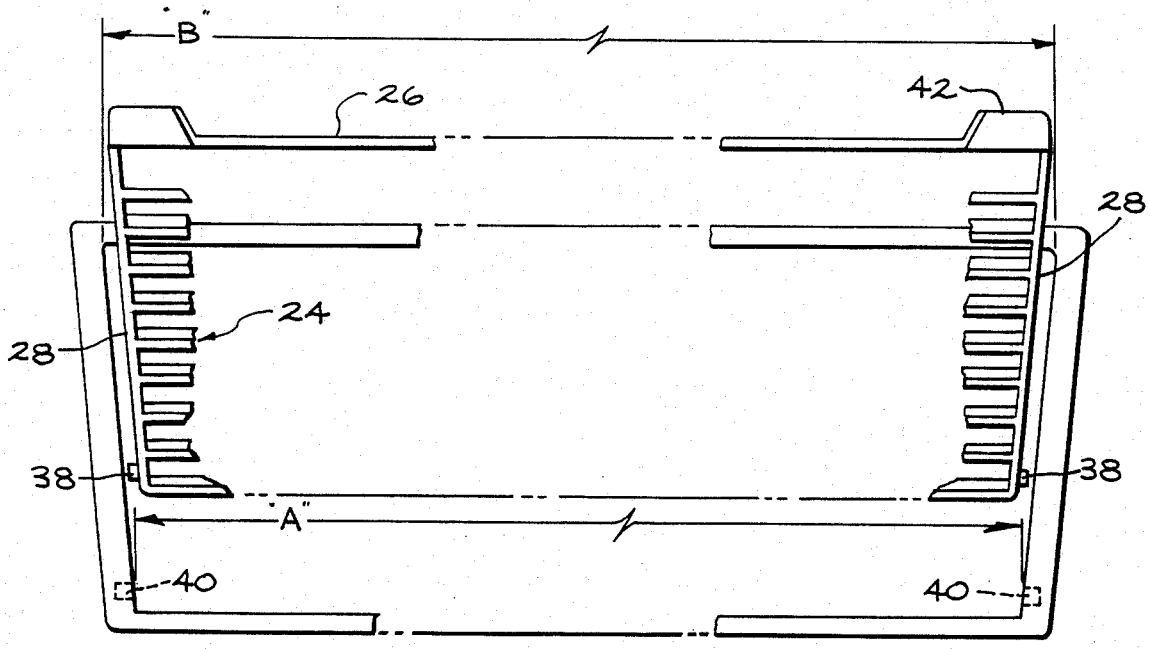
FIG. 7 is a partial plan view of the casing of a room air conditioning unit showing the discharge grille assembly.

Means are provided by the present invention which facilitate the placement of the grille 24 in the frame opening 20. To this end as best shown in FIG. 7, both the grille 24 and frame opening 20 are generally trapezoidal. In effect, the dimension "A" of the grille 24 as defined by the distal ends of the pintles 38 is less than the dimension "B" as defined by the wall 49 forming the longer end of the trapezoidal frame opeing 20. Accordingly, in assembling the grille 24 in its position relative to the frame opening 20, the grille 24 is arranged in opening 20 so that the pintles 38 are within the opening in the area of wall 49. The grille 24 is moved from this position in the frame opening 20 until the pintles 38 axially align with and are received in the opening 40.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. An air conditioning unit having a flow path through which conditioned air is discharged to a space which comprises:

a casing including an air intake opening in the front of said casing and a discharge frame defining a discharge opening having side walls, rear wall and a front wall at the top of said casing through which the conditioned air may flow;

a grille member including a frame dimensioned to be received in said discharge from having side walls, rear wall and a front wall, louvers extending between said side walls for directing air passing through said discharge opening;

pivot means operable between said side wall of said grille member frame and said discharge frame for allowing pivoting of said grille member relative to said discharge frame;

said pivot means include pintles projecting outwardly from said side walls of said grille member and a pivot opening on said side walls of said discharge opening for receiving said pintles;

said discharge opening and said grille member being generally trapezoidal with said front walls being shorter than said rear walls;

said pivot opening being arranged adjacent said shorter front wall of said discharge opening;

said pintles being arranged adjacent the shorter front wall of said grille member for allowing said shorter wall of said grille member to be initially inserted in said discharge opening with its shorter wall including said projecting pintles adjacent the longer rear wall of said discharge opening and for subsequently allowing movement of said grille member forwardly until said pintles and said pivot openings align and move into operative engagement;

tab means positioned on one of said frames cooperatively arranged to engage vertically spaced detents on the other of said frame for positioning said grille member relative to said top discharge opening for selectively directing air passing through said discharge opening;

stop means cooperatively arranged between said discharge frame and said grille member operable for maintaining said grille member within the dimensions of said discharge frame.

2. The air conditioning unit recited in claim 1 wherein said rear wall of said grille member frame is arcuate and said pintles are located generally at the point of generation of said arcuate rear wall of said grille member frame.

3. The air conditioning unit recited in claim 2 wherein said tab means is positioned on said arcuate rear wall of said grille member frame, and said vertically spaced detents are located on said discharge frame.

4. The air conditioning unit recited in claim 3 wherein said stop means includes a first projection on said rear wall of said grille member frame dimensioned to engage a second projection on said discharge frame.

5. The air conditioning unit recited in claim 3 wherein at least two tab means are spaced longitudinally on said rear wall of said grille member frame and said vertically spaced detents are formed on at least two arcuate rib members projecting from said discharge frame.

* * * * *